US005365143A

United States Patent [19]

Nishimura et al.

[11] Patent Number: 5,365,143

[45] Date of Patent: Nov. 15, 1994

[54] COLOR CATHODE RAY TUBE HAVING A PLURALITY OF MASKS

[75] Inventors: Takashi Nishimura; Kazuyuki Seino; Eiji Kamohara, all of Saitama, Japan

[73] Assignee: Kabushiki Kaisha Toshiba, Kawasaki, Japan

[21] Appl. No.: 904,069

[22] Filed: Jun. 26, 1992

[30] Foreign Application Priority Data

Jun. 28, 1991 [JP] Japan ..... 3-157283

[51] Int. Cl.[5] ..... H01J 29/07

[52] U.S. Cl. ..... 313/402; 313/407

[58] Field of Search ..... 313/2.1, 402, 407, 477 R

[56] References Cited

U.S. PATENT DOCUMENTS 3,071,706 1/1963 Waldorf ..... 313/2.1 X
4,714,856 12/1987 Takenaka et al. ..... 313/2.1
4,792,720 12/1988 Takenaka et al. ..... 313/477 R X
4,994,704 2/1991 Takenaka et al. ..... 313/477 R X

*Primary Examiner*—Sandra L. O'Shea
*Attorney, Agent, or Firm*—Cushman, Darby & Cushman

[57] ABSTRACT

A color cathode ray tube comprises a vacuum envelope including a substantially rectangular faceplate having a first axis and a second axis perpendicular to the first axis and a plurality of necks opposing to the faceplate. A plurality of electron gun assemblies are received in the necks respectively. A phosphor screen is formed on the inner surface of the faceplate and includes a plurality of continuous segment regions scanned with electron beams emitted from corresponding ones of the assemblies. The mask member is received in the vacuum envelope and has a plurality of effective regions through which the electron beam pass. A plurality of effective regions are formed into a plurality of groups.

24 Claims, 9 Drawing Sheets

COLOR CATHODE RAY TUBE HAVING A PLURALITY OF MASKS

BACKGROUND OF THE INVENTION

1. Field of the Invention

The present invention relates to a color cathode ray tube and, more particularly, to a color cathode ray tube of a multineck structure.

2. Description of the Related Art

Color cathode ray tubes in which a fluorescent screen in a vacuum envelope is scanned by electron beams and an image is displayed on the screen, are conventionally used as high definition broadcasting devices or computer terminal high resolution graphic display devices. For these applications, increased resolution is desirable. High resolution in a color cathode ray tube can be achieved by minimizing an electron beam spot on its screen. Conventional tubes have been improved by elongating the electron gun assembly and enlarging its diameter. These improvements have not been completely satisfactory because as the diameter of the tube is increased, the distance between the electron gun assembly and the screen also increases, resulting in undesirably large magnification of the electron lens. In other words, in order to achieve high resolution, it is important to shorten the distance between the electron gun assembly and the screen. For this purpose, the tube may be designed as a wide angle deflection tube. However, in such a tube, the magnification at the center region of the screen differs from that at the peripheral region thereof.

In order to solve the above problem, Japanese Patent Disclosure (Kokai) No. 48-90428 describes a multitube structure display device having a plurality of small or medium cathode ray tubes arranged in the horizontal or vertical direction to display an image on a large screen with high resolution.

A conventional display device of the multi-tube structure can be effectively used outdoors to display an image on a very large screen divided into blocks.

However, such a display device is not suitable for a medium-size screen, i.e., about 40 inches, since the joints of the divided blocks of the screen stand out and result in a poor image. In particular, when this display device is used as a computer-aided design graphic terminal, the presence of joints is a significant shortcoming.

In addition, U.S. Pat. No. 3,071,706, Japanese Utility Model Publication (Kokoku) No. 39-25641, and Japanese Patent Publication (Kokoku) No. 42-4928 and No. 50-17167 describe a multi-tube structure in which a plurality of independent tubes are integrated into a screen. However, in such an arrangement, when a screen is divided into a plurality of separately scanned segment regions, rasters in the adjacent segment regions overlap each other at their boundaries or have a blank therebetween and result in a poor image.

In order to solve this problem, Japanese Patent Disclosure (Koki) No. 61-256551 (U.S. Pat. No. 4,714,856) describes a color cathode ray tube having a multineck structure. As shown in FIG. 1, the color cathode ray tube comprises a vacuum envelope having a single faceplate 1, on which a phosphor screen 2 is formed, and a plurality of necks 3*a*, . . . 3*d*. A plurality of electron gun assemblies 4*a*, . . . 4*d* are respectively received in necks 3*a*, . . . 3*d*. Phosphor screen 2 is defined by a plurality of continuous segment regions each of which is scanned with electron beams 5R, 5G, and 5B from a corresponding electron gun assembly. A shadow mask 6 is received in the panel and faces the screen 2. The shadow mask 6 has a plurality of effective row and column regions 7 corresponding to the segment regions and a non-effective region 8 for surrounding and partitioning the respective segment regions. A plurality of deflection units 9*a*, . . . 9*d*, generating deflection magnetic fields, are respectively mounted in the vicinity of the electron gun assemblies 4*a*, . . . 4*b* to deflect the electron beams 5R, 5G, and 5B.

Generally, in a color cathode ray tube with a shadow mask, only 30% or less of the electron beams originally emitted by the electron guns pass through the apertures formed in the shadow mask. The remaining 70% or more of the beams impinge on the shadow mask, which may become heated. As a result, the shadow mask thermally expands and deforms. When it deforms, landing error occurs and color purity is degraded. In conventional color cathode ray tubes with one phosphor screen and one electron gun assembly, deformation of the shadow mask is symmetric about the center of the phosphor screen corresponding to the center of the shadow mask. In order to correct landing error, a means for adjusting the distance between mask and screen in response to the temperature of the shadow mask and the mask frame has been used.

In a color cathode ray tube having a multineck structure, as mentioned above, deformation is symmetric about the center of the shadow mask, similar to conventional tubes. As a result, the direction of deformation of each effective region relative to the corresponding segment region is different in accordance with its position in the shadow mask. Therefore, compensation of the landing error as used in a conventional tube is not effective in this type of tube.

SUMMARY OF THE INVENTION

It is an object of the present invention to provide a color cathode ray tube having a multineck structure and having advanced characteristics to prevent landing error.

In order to achieve the above object of the present invention, there is provided a color cathode ray tube comprising: a vacuum envelope including a substantially rectangular faceplate having an inner surface, a first axis and a second axis perpendicular to the first axis, and a plurality of necks opposing the faceplate; a plurality of electron gun assemblies respectively received in the necks, each electron gun assembly emitting an electron beam; a phosphor screen formed on the inner surface of the faceplate, including a plurality of continuous segment regions scanned with electron beams emitted from corresponding electron gun assemblies; and a mask member received in the vacuum envelope and facing the faceplate, the mask member having a plurality of effective regions through which the electron beams pass, said plurality of effective regions being formed into a plurality of groups each of which has at least one effective region and non-effective region for surrounding the effective region, wherein the number of the effective regions which are connected through the non-effective region in the first axis is equal or less than number of the effective regions in the second axis in each of said groups.

According to the present invention, there is also provided a color cathode ray tube of multineck structure comprising: a vacuum envelope including a faceplate having an inner surface, a first axis and second axis perpendicular to the first axis, and a plurality of necks opposing the faceplate; a plurality of electron gun assemblies respectively received in the necks, each electron gun assembly emitting an electron beam; a phosphor screen formed on the inner surface of the faceplate, including a large number of spaced groups of different color phosphor stripes each extending continuously along the second axis for emitting rays of different colors in response to an impinging electron beam, and defined by a plurality of continuous segment regions scanned with electron beams emitted from corresponding electron gun assemblies; and a mask member received in the vacuum envelope and facing the faceplate, including a plurality of effective regions each corresponding to the segment regions and non-effective regions surrounding the effective regions, the effective regions being provided with a large number of apertures for allowing passage of electron beams therethrough to impinge on the phosphor stripes in the corresponding segment regions, the effective regions being substantially separated at predetermined intervals into several portions along the first axis.

DETAILED DESCRIPTION OF THE PREFERRED EMBODIMENTS

An embodiment of the present invention will be explained with reference to the drawings.

Figure 1:
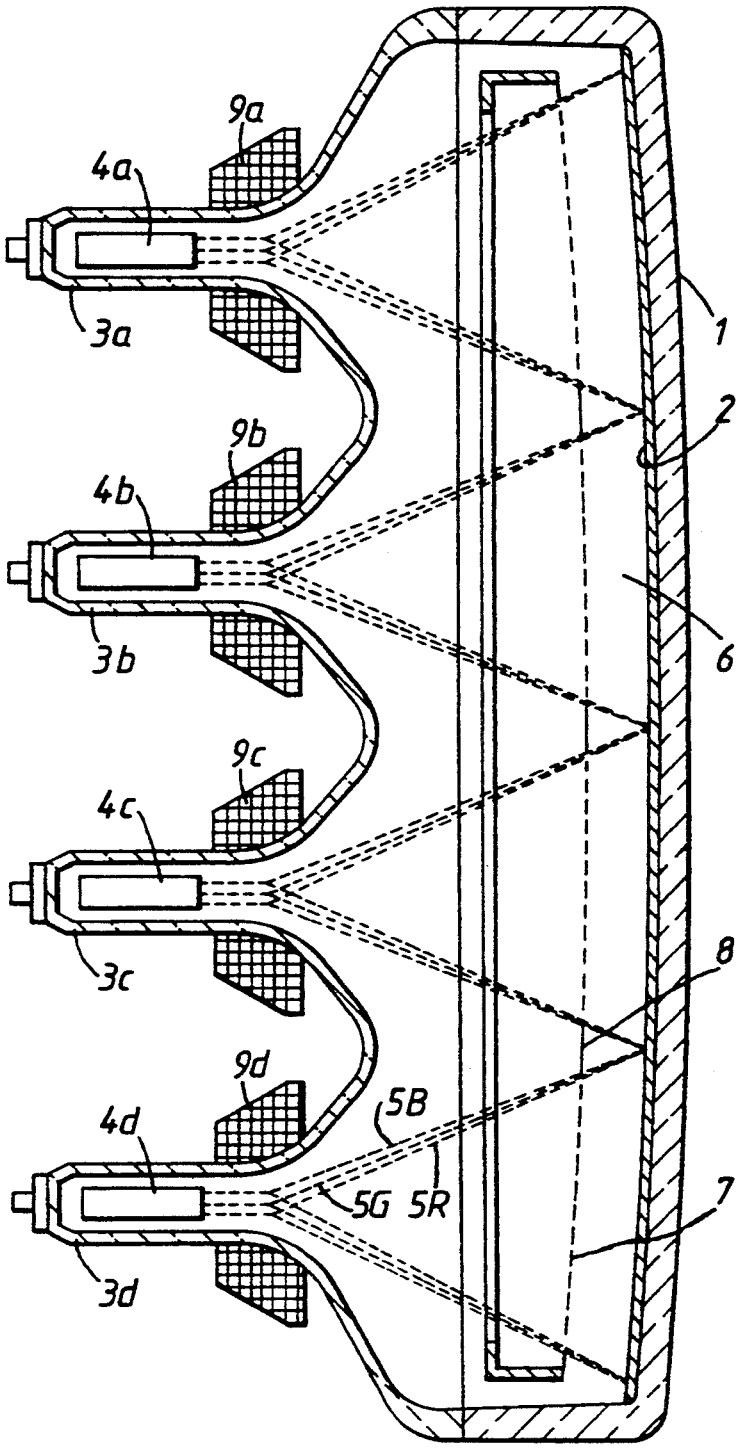
Fig.1. PRIOR ART
FIG. 1 is a sectional view of a color cathode ray tube having a multineck structure according to the prior art.
Figure 2:
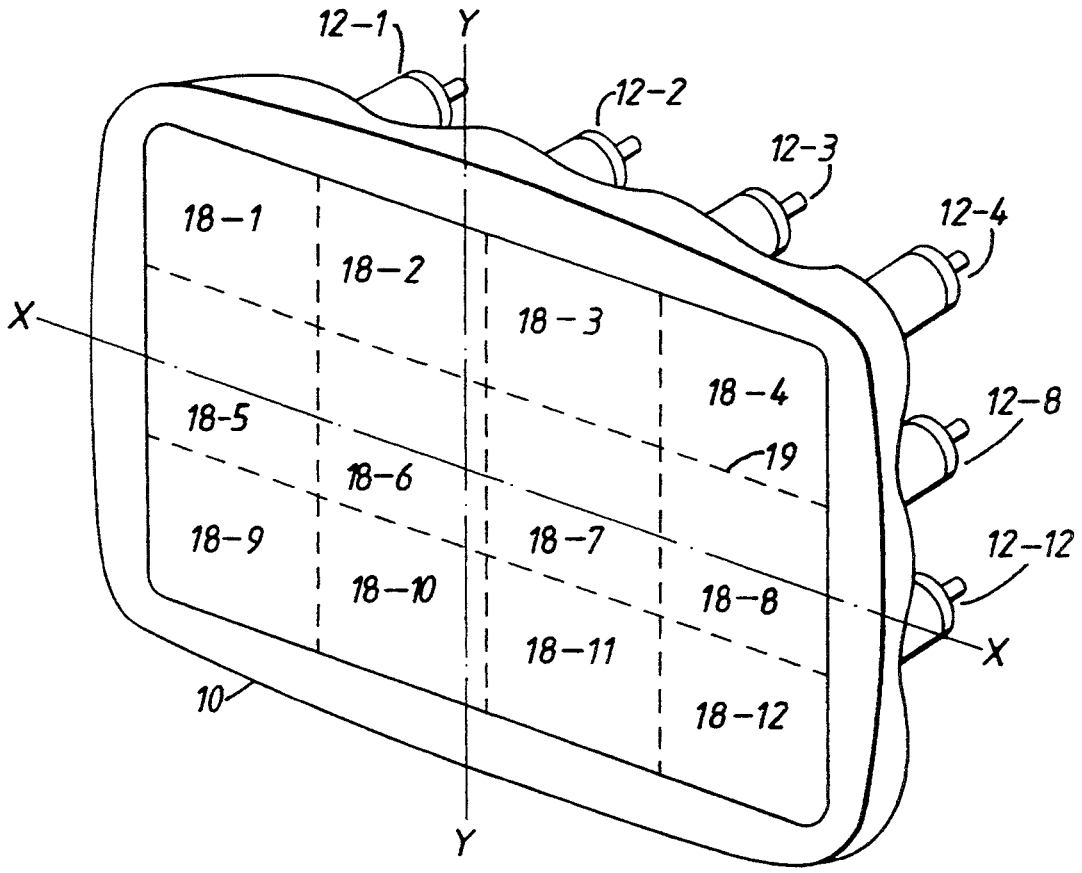
FIG. 2 is a perspective view of a color cathode ray tube having a multineck structure according to a first embodiment of the present invention.
Figure 3:
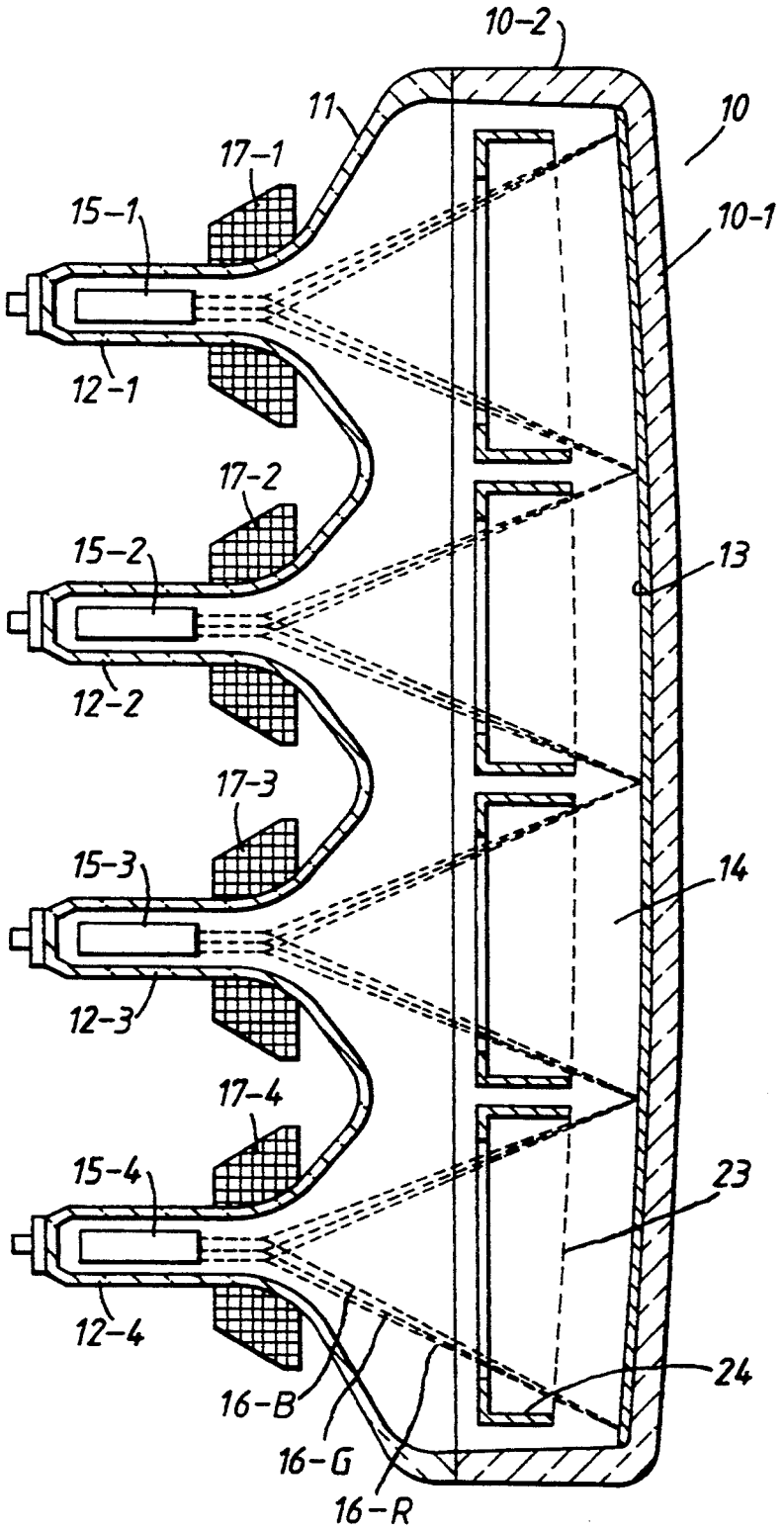
FIG. 3 is a cross sectional view of the color cathode ray tube in FIG. 2 taken along the line X—X thereof.
Figure 4:
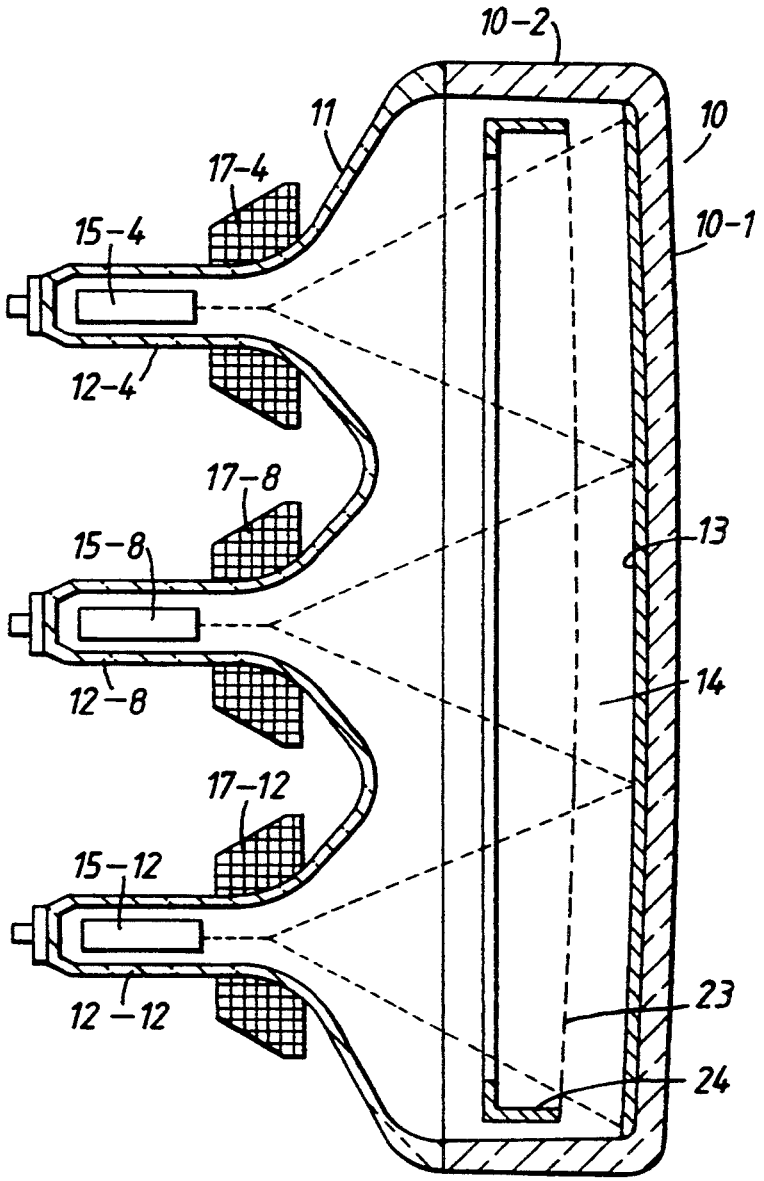
FIG. 4 is a cross sectional view of the color cathode ray tube in FIG. 2 taken along the line Y—Y thereof.

Referring to FIGS. 2 to 5, there is illustrated a first embodiment of a color cathode ray tube having a multineck structure according to the present invention. FIG. 2 is a perspective view showing the entire structure and FIGS. 3 an 4 are cross-sectional views of FIG. 2. The color cathode ray tube comprises a vacuum envelope including a panel 10 having a faceplate 10-1 and skirt 10-2 extending along the edge of faceplate 10-1, and funnel 11 hermetically coupled to skirt 10-2 of panel 10. A plurality of necks 12-1, . . . 12-12 are hermetically coupled to funnel 11. Faceplate 10-1 is substantially rectangular, and has a first axis and a second axis perpendicular to the first axis. In this embodiment, the first axis is the X—X axis and the second axis is the Y—Y axis. According to this embodiment, there are twelve necks, four columns in the horizontal direction (X—X axis) and three rows in the vertical direction (Y—Y axis). A phosphor screen 13 is formed on the inner surface of faceplate 10-1 of panel 10, which screen includes a large number of groups each consisting of red, green and blue phosphor stripe layers. Each phosphor stripe extends continuously along the vertical direction (Y—Y axis). Mask member 14 is mounted on the inner surface of skirt 10-2 of panel 10 so as to face screen 13. Electron gun assemblies 15-1, . . . 15-12, each emitting substantially three different electron beams 16-R, 16-G, and 16-B toward the screen 13, are respectively received in the necks 12-1, . . . 12-12. Therefore, the color cathode ray tube, in the present invention, includes an electron beam generating means have a plurality of electron gun assemblies 15-1, . . . 15-12, in the form of the twelve electron gun assemblies as shown in FIGS. 2 to 4. A plurality of deflecting units 17-1, . . . 17-12, generating deflection magnetic fields, are respectively mounted on the outer surface of the funnels to deflect the electron beams 16-R, 16-G, and 16-B emitted form electron gun assemblies 15-1, . . . 15-12.

Beams 16-R, 16-G, and 16-B are deflected by corresponding deflection units 17-1, . . . 17-12. A single screen is defined as a set of segment regions 18-1, . . . 18-12, divided with dashed lines 19, as drawn and respectively corresponding to electron gun assemblies 15-1, . . . 15-12. Segment regions 18-1, . . . 18-12 are scanned with the respective set of deflected beams 16-R, 16-G, and 16-B. These segment regions 18-1, . . . 18-12 are connected by a signal applied to electron gun assemblies 15-1, . . . 15-12 and deflection units 17-1, . . . 17-12, and one large image is reproduced on the entire screen.

Figure 5:
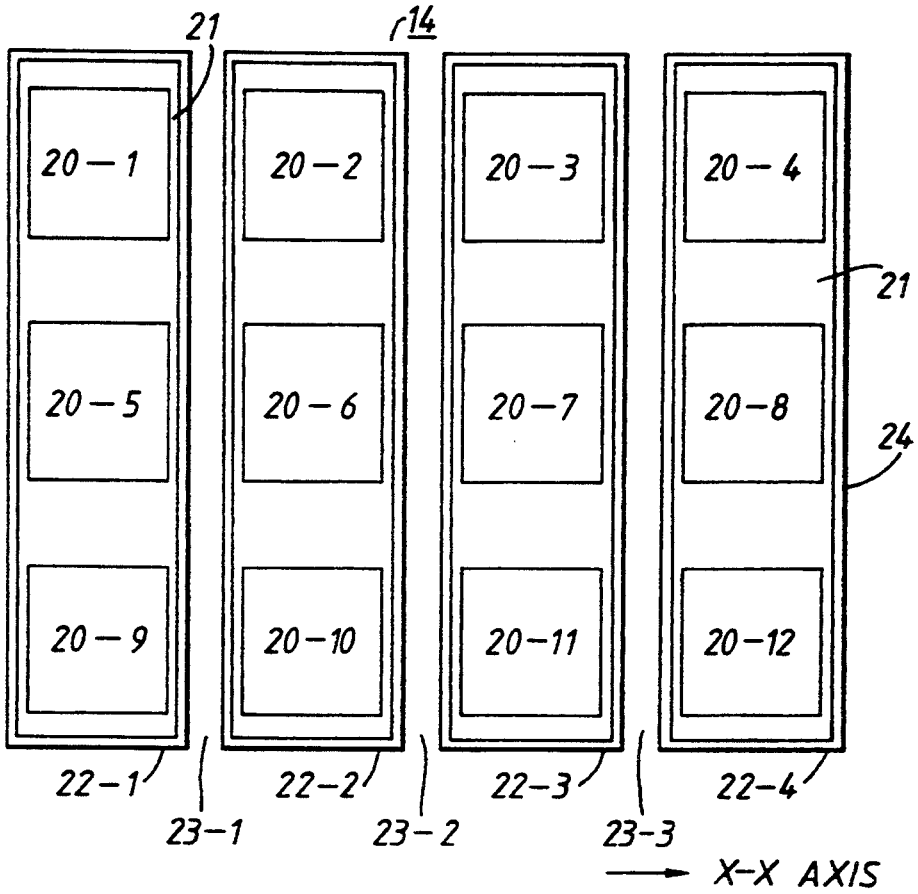
FIG. 5 is a plan view of a mask member according to the present invention.

As shown in FIG. 5, mask member 14 includes a plurality of effective regions 20-1, . . . 20-12, respectively corresponding to segment regions 18-1, . . . 18-12 and each having a large number of apertures for passing electron beams, and non-effective regions 21 surrounding the effective regions 20-1, . . . 20-12. Effective regions 20-1, . . . 20-12 are connected through non-effective regions 21 in the vertical direction parallel to the longitudinal axis of the phosphor stripes, and are separated into several parts in the horizontal direction perpendicular to the longitudinal axis of the phosphor stripes, to constitute a plurality of individual masks 22-1, . . . 22-4, as drawn. Therefore, the mask member 14 is comprised of a plurality of groups each of which has at least one effective region. The width of the non-effective regions, at where effective regions are divided in the horizontal direction, is about 10% of the horizontal width of the effective regions. Individual masks 22-1, . . . 22-4 are received at predetermined intervals in the horizontal direction to provide gaps or isolation opening 23-1, . . . 23-4 between adjacent individual masks 22-1, . . . 22-4.

Moreover, each of individual masks 22-1, . . . 22-4 includes a shadow mask 23, which is made of a single iron plate and which has a plurality of effective regions and non-effective regions, and mask frame 24 for supporting shadow mask 23. Therefore longitudinal axis of individual masks 22-1, . . . 22-4 are parallel to the vertical direction (Y—Y axis) of the phosphor stripes.

The operation of this embodiment of the present invention will now be described.

In the above structure, that is, a color cathode ray tube having a single phosphor screen 13, formed substantially continuously with a large number of groups, each consisting of different colors of phosphor stripes extending continuously along the vertical direction, a plurality of electron gun assemblies 15, and a mask member 14 having a plurality of effective regions and being separated in the horizontal direction into individual masks 22-1, . . . 22-4, electron beams impinge on the masks as in a conventional tube. As a result, the individual masks 22-1, . . . 22-4 thermally expand and deform.

In the present invention, the magnitude of the electron beam displacement caused by deformation of the masks 22-1, . . . 22-4 may be reduced in proportion to the separation of the mask member 14, i.e., the number of individual masks. For example, in a case where the mask member 14 is separated into four individual masks 22-1, . . . 22-4, as shown, the magnitude of the deformation is $\frac{1}{4}$ of the conventional type, in which mask member is not separated. Furthermore, deformation is substantially symmetric about the center of each individual mask 22-1, . . . 22-4. Landing error will occur in the vertical direction as well as in the horizontal direction. However, since each of the phosphor stripes extends continuously along the vertical axis, emission of rays of different color and landing electron beams on areas other than phosphor stripes are prevented. Therefore, degradation of color purity caused by vertical landing error can be prevented according to the present invention.

While deformation of the mask member 14 due to thermal expansion does not have a significant effect on color purity, the relationship between each segment region 18-1, . . . 18-12 of screen 13 and effective regions 20-1, . . . 20-12 of the mask member may change. As a result, a non-light-emitting area may be present at the top and bottom of a raster. This phenomenon, which is the electron beam scanning of a non-light-emitting area, may be prevented by designing the vertical length of the effective region to be larger than or equal to the size required to form a continuous large raster on the screen when thermal expansion does not occur.

The above structure reduces the precision, in the vertical direction, necessary to position the mask member against the faceplate.

It is also possible to compensate for landing error without correction means. For example, in the case where the phosphor screen 13 measures 406.4 mm in the horizontal axis and 304.8 mm in the vertical axis, and is divided into twelve segment regions 18-1, . . . 18-12 of 101.6 mm×101.6 mm, and mask member 14 is made of Al-killed steel, the magnitude of deformation of the mask member 14 is about 10 um. In general, such minor deformation does not need landing error correcting means.

In the case where each segment region 18-1, . . . 18-2 is larger than that of above mentioned embodiment or in the case where the size and pitch of the apertures formed on the effective regions 20-1, . . . 20-12 of the mask member are smaller, as in a high resolution color cathode ray tube, landing error may be compensated with conventional landing error correcting means.

Moreover, a landing error correcting means is not needed if the mask member is formed of a material which has a low thermal expansion coefficient, such as invar alloy.

It will be appreciated that modifications may be made to the present invention. In the above mentioned embodiment, the mask member 14 is separated into several parts in the direction perpendicular to phosphor stripes and to constitute several individual masks. The number of individual masks is determined in accordance with the deformation caused by thermal expansion. In case the thermal expansion coefficient or deformation of the mask member 14 is small, or in the case that each effective region 20-1, . . . 20-12 is small in response to the size of the phosphor screen 13, all effective regions are not necessarily separated between the adjacent effective regions in the horizontal direction. Moreover, in the above structure, the effective regions 20-1, . . . 20-12 of the mask member 14 are divided in the horizontal direction to constitute several individual masks 22-1, . . . 22-4, and each individual mask includes a plurality of effective regions continuous through non-effective regions in the vertical direction. The effective regions of each individual mask are also divided in the vertical direction into several parts. For example, a slit or projecting portion for absorbing the deformation between vertically adjacent effective regions may be provided. As a result, deformation of each mask is reduced compared with the above mentioned embodiment. Moreover, a mask member 14 without a mask frame 24 is also possible.

Figure 6:
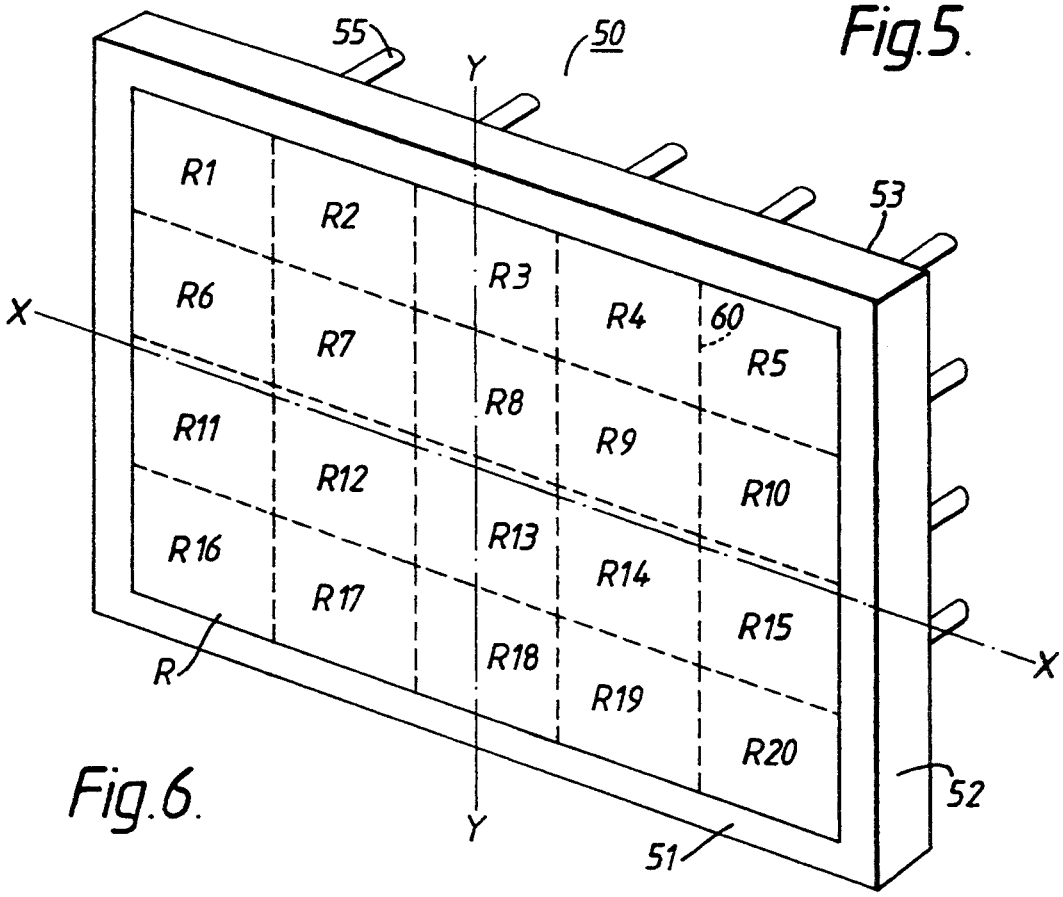
FIG. 6 is a perspective view of a color cathode ray tube having a multineck structure according to a second embodiment of the present invention.
Figure 7:
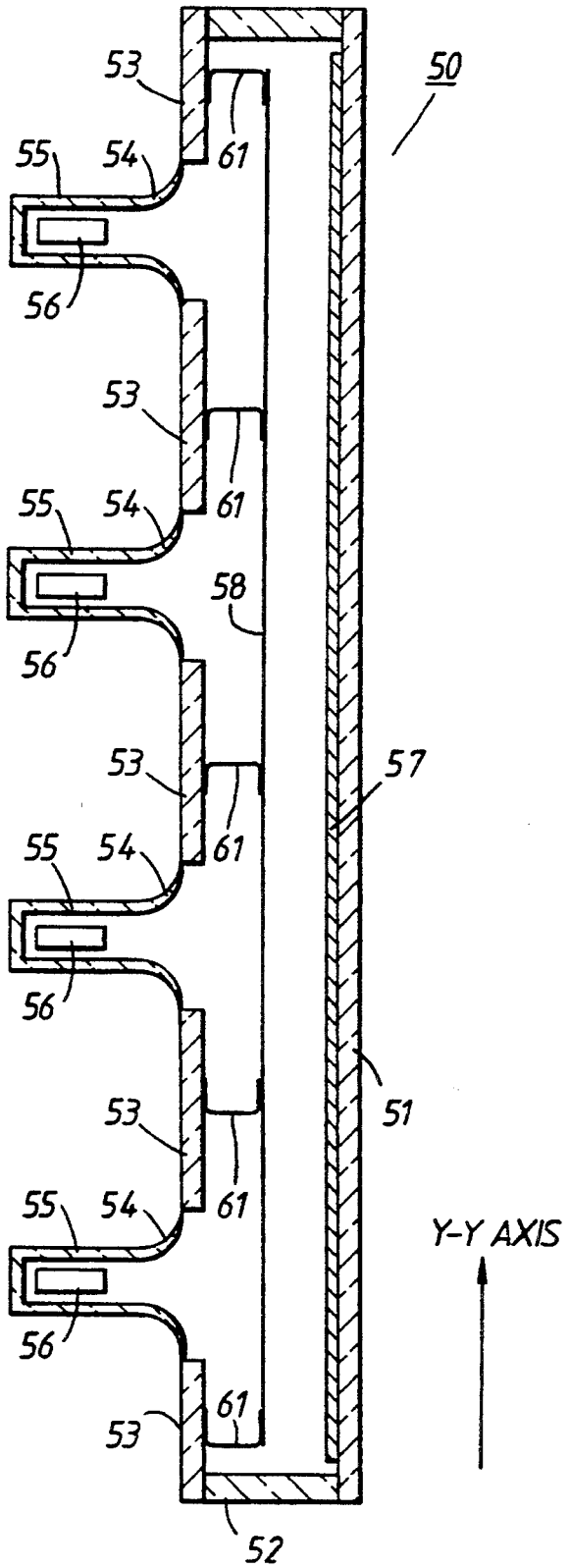
FIG. 7 is a cross-sectional view of the color cathode ray tube in FIG. 6 taken along the line Y—Y thereof.

FIGS. 6 to 9 show a second embodiment of a color cathode ray tube according to the present invention. FIG. 6 is a perspective view showing the entire structure, and FIG. 7 is cross-sectional view of FIG. 6. In this embodiment, a color cathode ray tube 50 comprises a vacuum envelope including a flat faceplate 51, a side wall 52, which is provided around the faceplate and extends in a direction which is substantially perpendicular to the faceplate 51, a rearplate 53 opposing the faceplate 51, a plurality of funnels 54, and a plurality of necks 55, which are continuous to the rearplate 53. The faceplate 51 may be formed of glass. The rearplate 53 may also be formed of glass, and openings are formed at predetermined positions. The funnels 54 are bonded to the rearplate 53 around the openings. Between the faceplate 51 and rearplate 53 and in the vicinity of the openings, there are fixed support members (not shown), for supporting the faceplate 51 against atmospheric pressure.

A phosphor screen 57 is formed on the inner surface of the faceplate 51, and includes a large number of groups each consisting of red, green and blue phosphor stripe layers. Each phosphor stripe extends continuously along the vertical direction (Y—Y axis). In each neck 55, there is enclosed an electron gun assembly 56 generating substantially red, green and blue electron beams. In the vicinity of the electron gun assembly 56, there is provided a deflection unit (not shown).

Similar to the first embodiment, the electron beams emitted from each electron gun assembly are deflected and scan the phosphor screen 57 so that light rays are emitted form the phosphor screen 57. Then, rasters R1, . . . R20, which correspond to small segment regions each having the same size, are drawn. These small raster regions are connected by a signal applied to the electron gun assemblies 56 and deflection units, and one large raster is formed on the entire screen.

In this embodiment, mask member 58 is provided with support girder 61, which is mounted on the rearplate 53 and serves as a support member, as shown in FIG. 7. This embodiment does not include a mask frame as described in the first embodiment. Mask member 58 is flat and parallel to the faceplate 51, and tension, parallel to the phosphor stripe, is applied to the mask member 58.

Figure 8:
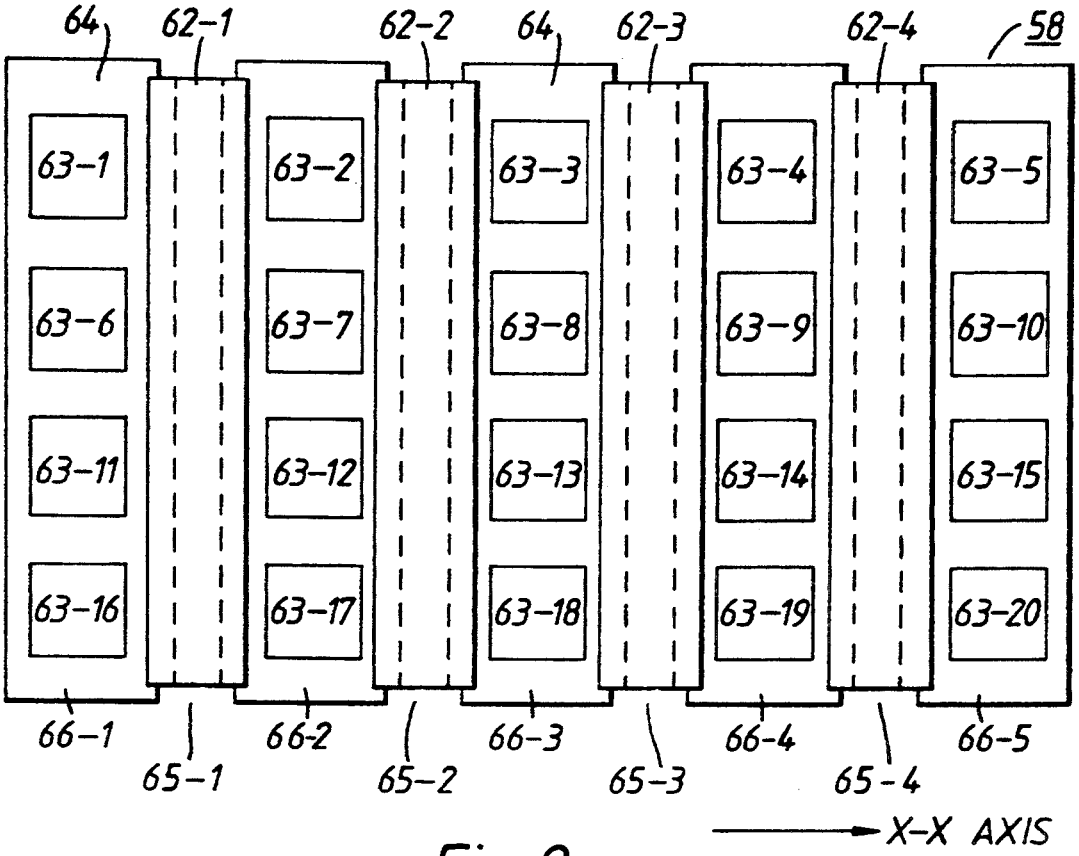
FIG. 8 is a plan view of another structure of a mask structure of a mask member according to the present invention.
Figure 9:
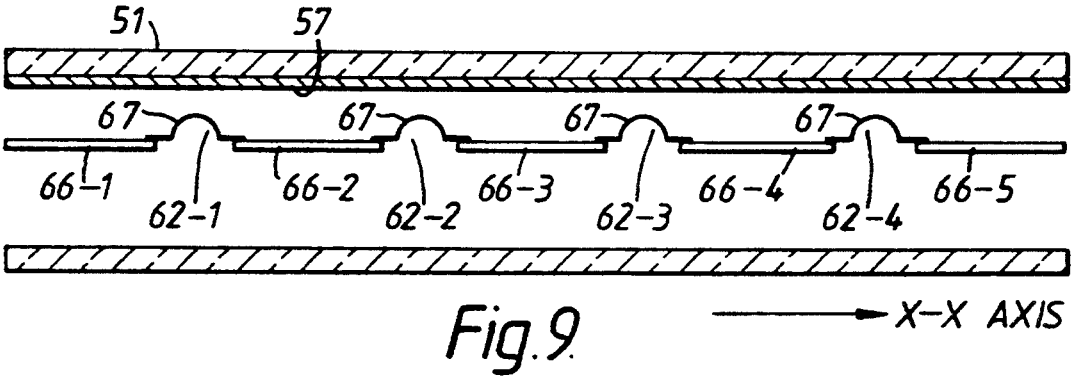
FIG. 9 is a partial sectional view of the color cathode ray tube having the mask member in FIG. 8.

FIGS. 8 and 9 show a mask member 58 according to this embodiment. FIG. 8 is a plan view of mask member 58 and FIG. 9 is partial sectional view. Therefore, funnels 54, electron gun assembly 56 and support girder 61 are not shown in FIG. 9. Mask member 58 includes a plurality of effective regions 63-1, . . . 63-20, each of which has a large number of apertures for allowing beam passage, and non-effective regions 64 surrounding effective regions 63-1, . . . 63-20. The mask member 58 is separated in the horizontal direction (X—X axis), perpendicular to the direction of phosphor stripes, into several individual masks 66-1, . . . 66-5. Each of individual masks 66-1, . . . 66-5 includes a plurality of effective regions arranged along the vertical direction, and non-effective regions surrounding the effective regions. Gaps 65-1, . . . 65-4 are provided between adjacent individual masks 66-1, . . . 66-5. Shielding means 62-1, . . . 62-4 are provided at the adjacent edge of individual masks 66-1, . . . 66-5, for shielding the gap 65-1, . . . 65-4, and for structurally connecting individual masks 66-1, . . . 66-5. Moreover, each shielding means 62-1, . . . 62-4 includes means for absorbing deformation of the mask member 58 and functionally divides each of the individual masks 66-1, . . . 66-5. In this embodiment, the means for absorbing deformation is a circular arc-like projecting portion 67, which projects towards screen 57 of strip-like shielding means 62-1, . . . 62-4.

In the color cathode ray tube of this embodiment, continuous rasters are formed on the screen by deflecting and scanning three electron beams from each one of a plurality of electron gun assemblies 56. In order to prevent the boundary of the rasters from standing out due to the change in a circuit over time or due to the effect of the earth's magnetic field, the electron beams are deflected over ranges W+d larger than predetermined effective ranges W. The electron beams deflected to overscanning ranges d are shielded by the non-effective region 64 and do not reach the screen. Therefore, the rasters are smoothly continuous on screen. The size of overscanning range d is 10% of the effective raster size, similar to the first embodiment. Overscanning of electron beams and shielding the electron beams deflected to the overscanning range are necessary to prevent errors caused by characteristics of the deflection unit or errors in mounting precision.

In this embodiment, deformation of the mask member is larger than in the first embodiment for the following reasons. Since mask member 58 is mounted directly on the rearplate 53 with support girder 61, and does not include a mask frame as in the first embodiment, the thermal capacity of mask member 58 is reduced. Therefore, any increase in temperature due to the impingement of electron beams is larger than that of the first embodiment, and deformation of the mask member 58 increases. In addition, when the curvature radius of mask member 58 is increased, electron beam displacement due to mask member deformation increases. As a result, the beam displacement in the flat mask of this embodiment is larger than that of the curved mask described in the first embodiment. Moreover, due to the difference in thermal capacity between the effective regions and the non-effective regions, the edge portions, where the effective regions and the non-effective regions adjoin, deform more easily than the central portion of the effective region. This results in landing error, which becomes more pronounced when the width of the non-effective region is increased. Therefore, it is desirable to equalize the thermal capacity between the effective and non-effective regions by minimizing the width of the non-effective region. However, a wider non-effective region is desirable to effectively shield overscanning electron beams. In order to satisfy these opposing requirements, the mask member 58 in this embodiment includes a narrow non-effective region 64 and a shielding means 62-1, . . . 62-4 which functions as a non-effective region.

Furthermore, low rigidity in the shielding means 62-1, . . . 62-4 is desirable in order not to limit deformation of the mask member 58 caused by thermal expansion. In this embodiment, the shielding means is a stripe-like member having a projecting portion 67 (means for absorbing deformation), and the rigidity of the shielding means is reduced by the projecting portion 67. The thickness of individual masks 66-1, . . . 66-5 is 0.13 mm and the thickness of shielding means 62-1, . . . 62-4 is 0.025 mm, and the radius of curvature of circular arch-like projecting portions 67 is 3 mm.

It will be appreciated that modifications may be made to the present invention. For example, a triangular or wavy form of the projecting portion 67 of the shielding means may be used. Moreover, the shielding means may be divided in the vertical direction, or provided only where the non-effective region does not have enough width to shield an overscanning electron beam. When the shielding means is made thinner, the rigidity is reduced and where the shielding means is made of thin plate of 10 um or less, a shielding means without a projecting portion may be used. Moreover, if the individual masks are made of a material with a low thermal expansion coefficient, or if the width of the individual mask is made small in order to reduce deformation, the projecting portion 67 may be dispensed with.

Figure 10:
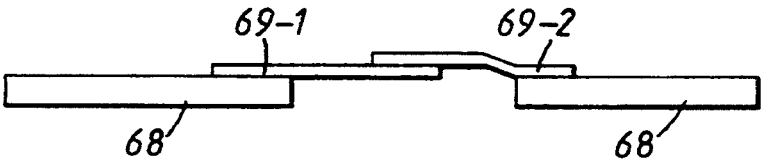
FIG. 10 is a partial sectional view of another structure of a mask member according to the present invention.

FIG. 10 shows another structure of the shielding means. The shielding means of this embodiment comprises overlapping plate-like members 69-1 and 69-2, each of which is connected at one side to the individual mask 68. The other side of the plate-like members is free. These members absorb deformation by a slipping motion between the two plate-like members 69 and 69-2.

Figure 11:
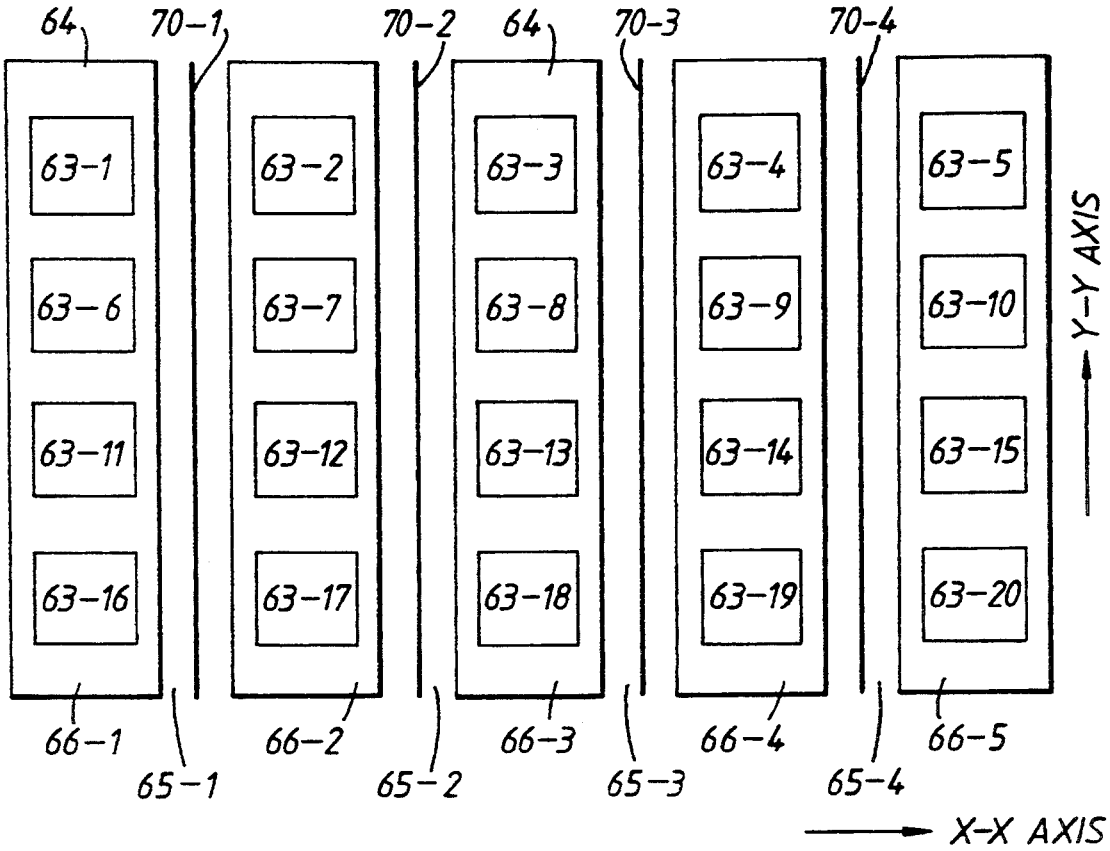
FIG. 11 is a plan view of another structure of a mask member and shielding means according to the present invention.
Figure 12:
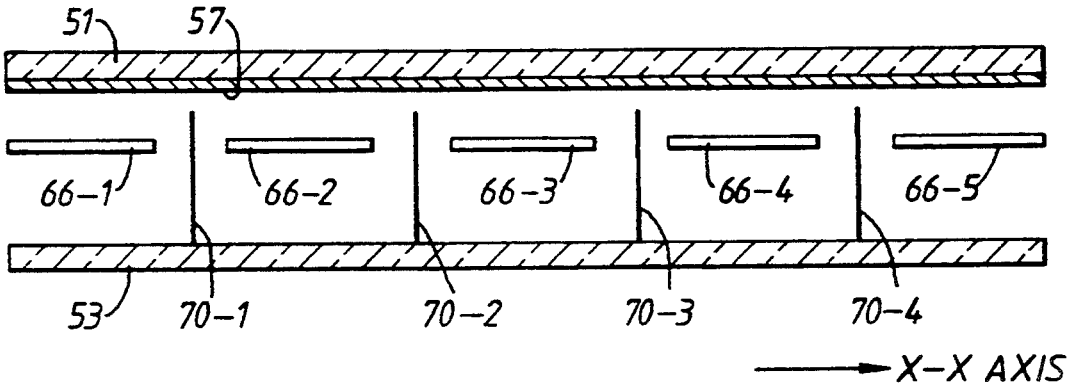
FIG. 12 is a partial sectional view of the color cathode ray tube having the mask member and shielding means in FIG. 11.

Shielding means as mentioned above are structurally connected to individual masks. In this invention, structurally separated shielding means may also be implemented. For example, as shown in FIGS. 11 and 12, the shielding means may comprise shield plates 70-1, . . . 70-4 provided on the rearplate 53 and extending to the gaps 65-1, . . . 65-4 between individual masks 66-1, . . . 66-5, in a direction which is substantially perpendicular to the rearplate 53 and individual masks 66-1, . . . 66-5. In this structure, tops of shielding plates 70-1, . . . 70-4 are preferably located between the surfaces of individual masks 66-1, . . . 66-5 and phosphor screen 57.

Furthermore, the structure of the mask member, according to the present invention, is not limited to the above mentioned embodiments. Partially divided and partially connected structures may also be used.

Another embodiment of the present invention will be explained with reference to FIG. 13, which is a plan view of a mask member according to this embodiment. In this embodiment, the structure of a color cathode ray tube is similar to the above mentioned embodiment except for the mask member.

Figure 13:
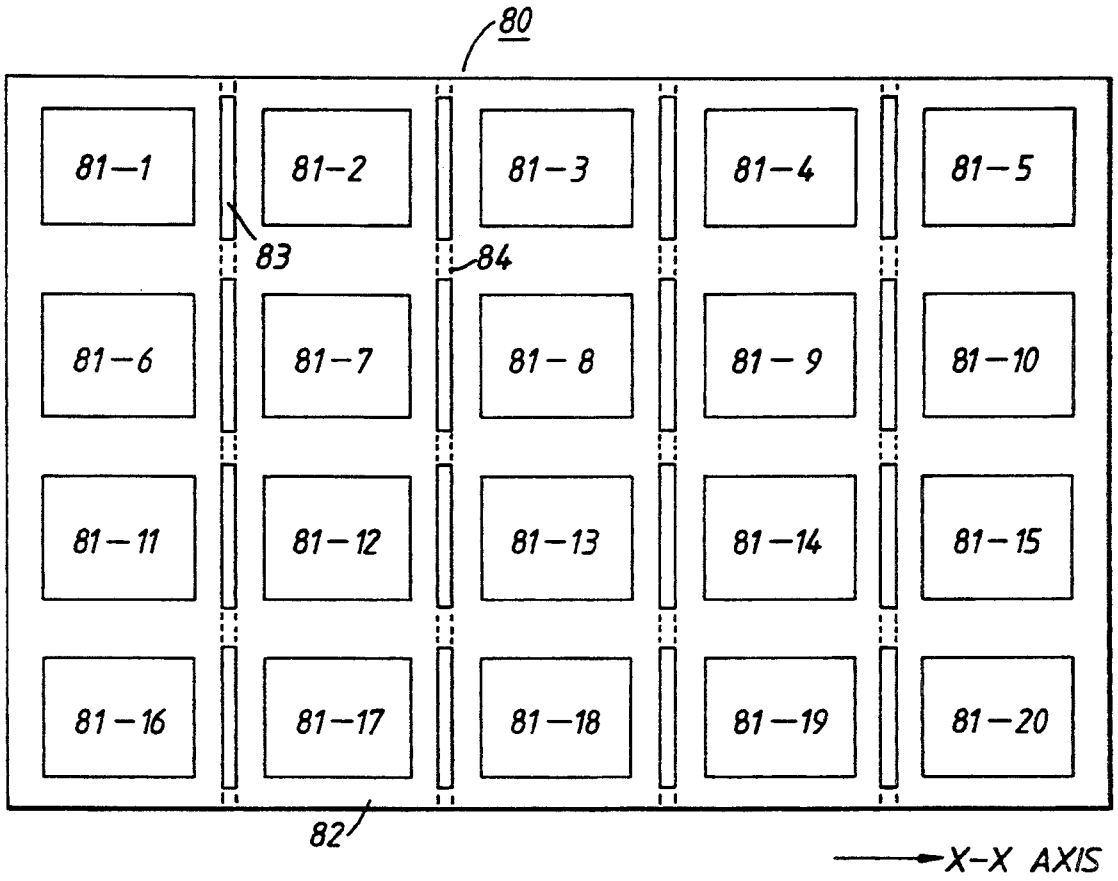
FIG. 13 is a plan view of another structure of a mask means according to the present invention.

As shown in FIG. 13, mask member 80 does not include a shielding member, and is functionally divided without being separated structurally into individual masks.

As discussed previously, the width of the non-effective region for shielding an overscanning electron beams is about 10% of the width of the effective region. Therefore, in order not to use a shielding means and not to limit deformation, the non-effective regions are made wide enough to shield overscanning electron beams, and several slits are formed between adjacent effective regions to functionally divide effective regions in the horizontal direction.

As shown in FIG. 13, mask member 80 includes a plurality of effective regions 81-1, . . . 81-20, each of which has a large number of apertures for passing electron beams, non-effective regions 82 surrounding the effective regions 81-1, . . . 81-20, and a plurality of slits, or isolation openings, 83, formed between horizontally adjacent effective regions. The mask member 80 also includes a plurality of groups of effective regions and each of the groups has a longitudinal axis parallel to the phosphor stripes. Slits 83 are connected through half-etched portions 84 in the vertical direction (Y—Y axis), and the vertical length of each slit is longer than that of the effective regions. Since the rigidity of the mask member 80 is reduced at the portion where slits 83 and half-etches 84 are provided, the portion serves as a means for absorbing deformation of the mask member 80. Furthermore, in order to prevent mask member 80 from deforming due to differences of rigidity between the slit portion and the half-etched portion, the length of slit 83 is made longer than that of effective regions 81-1, . . . 81-20.

In this embodiment, the mask member 80 is functionally separated into several parts, in the direction perpendicular to the phosphor stripes, between the adjacent effective regions.

If the thermal expansion coefficient or deformation of the mask member is small, or if each effective region is small compared to the size of the phosphor screen, all effective regions are not necessarily separated between the adjacent effective regions in the horizontal direction. Furthermore, slits may be provided between vertically adjacent effective regions in addition to slits 83.

Moreover, it will be appreciated that modifications may be made to the above embodiments of the present invention. For example, a mask member may be used which has a longitudinal axis in the horizontal direction, and which has individual masks received at predetermined intervals in the vertical direction.

What is claimed is:

1. A color cathode ray tube comprising:

a vacuum envelope including a faceplate having an inner surface, a first axis, and a second axis perpendicular to the first axis, and a plurality of necks opposing the faceplate;

an electron gun assembly received in each of the necks, each electron gun assembly for emitting an electron beam;

a phosphor screen formed on the inner surface of the faceplate, including a plurality of continuous segment regions scanned with an electron beam emitted from corresponding ones of the electron gun assemblies; and a mask member received in the vacuum envelope and facing the faceplate, the mask member having a plurality of individual masks, each of which has at least one effective region through which the electron beams pass and at least one non-effective region surrounding the effective regions, wherein each individual mask is substantially separated from adjacent individual masks along the first axis, wherein the number of effective regions in the first axis of each individual mask is equal to or less than the number of effective regions in the second axis of each individual mask, and wherein the mask member includes a gap between the adjacent individual masks.

2. A color cathode ray tube according to claim 1, wherein the individual masks each comprise a shadow mask facing the screen and a mask frame for supporting the shadow mask.

3. A color cathode ray tube according to claim 1, further comprising shielding means provided between the adjacent individual masks for preventing the passage of electron beams.

4. A color cathode ray tube according to claim 3, wherein the shielding means includes means for absorbing deformation of the mask member along the first axis.

5. A color cathode ray tube according to claim 4, wherein the means for absorbing deformation of the mask member comprises a circular arc-like projection of the shielding means.

6. A color cathode ray tube according to claim 4, wherein the means for absorbing deformation of the mask member comprises at least two plate-like members, each connected on one side to the adjacent edge portion of the individual masks, the plate-like members overlapping each other.

7. A color cathode ray tube according to claim 3, wherein the shielding means are separate from the individual masks, and are disposed where the individual masks adjoin.

8. A color cathode ray tube according to claim 1, wherein the faceplate and the mask member are flat.

9. A color cathode ray tube according to claim 8, wherein the vacuum envelope further includes a rear-plate opposing the faceplate, and the mask member is supported by a support member received on the rear-plate.

10. A color cathode ray tube according to claim 8, wherein a tension, parallel to the second axis, is applied to the mask member.

11. A color cathode ray tube comprising:

a vacuum envelope including a faceplate having an inner surface, a first axis, and a second axis perpendicular to the first axis, and a plurality of necks opposing the faceplate;

an electron gun assembly received in each of the necks, each electron gun assembly for emitting an electron beam;

a phosphor screen formed on the inner surface of the faceplate, including a plurality of continuous segment regions scanned with an electron beam emitted from corresponding ones of the electron gun assemblies; and a mask member received in the vacuum envelope and facing the faceplate, the mask member comprising a plate having a plurality of effective regions through which the electron beams pass and at least one slit provided at a predetermined interval between adjacent effective regions along the first axis, the slit having its longitudinal axis along the second axis, said plurality of effective regions being formed into a plurality of groups each of which has at least one effective region and at least one non-effective region surrounding the effective regions, wherein the number of effective regions in the first axis is equal to or less than the number of effective regions in the second axis in each of said groups.

12. A color cathode ray tube according to claim 11, wherein the mask member includes a half-etched portion formed between adjacent slits along the second axis.

13. A color cathode ray tube according to claim 11, wherein the length of the slit along the second axis is longer than the length of the effective region along the second axis.

14. A color cathode ray tube according to claim 11, wherein said phosphor screen includes a plurality of spaced groups of different color phosphor stripes extending continuously along the second axis.

15. A color cathode ray tube comprising:

a vacuum envelope including a faceplate having an inner surface, a first axis, and a second axis perpendicular to the first axis, and a plurality of necks opposing the faceplate;

an electron gun assembly received in each of the necks, each electron gun assembly emitting an electron beam;

a phosphor screen formed on the inner surface of the faceplate, including a plurality of continuous segment regions scanned with an electron beam emitted from corresponding ones of the electron gun assemblies; and a mask member received in the vacuum envelope and facing the faceplate, the mask member having a plurality of effective regions through which the electron beams pass, said plurality of effective regions being formed into a plurality of groups which are thermally separated by isolation openings therebetween, each of the groups having at least one effective region and at least one non-effective region for surrounding the effective regions, wherein the number of effective regions in the first axis is equal to or less than the number of effective regions in the second axis in each of said groups.

16. A color cathode ray tube according to claim 15, wherein the groups each comprise a shadow mask facing the screen and a mask frame for supporting the shadow mask.

17. A color cathode ray tube according to claim 15, further comprising shielding means provided between the adjacent groups for preventing the passage of electron beams.

18. A color cathode ray tube according to claim 17, wherein the shielding means includes means for absorbing deformation of the mask member along the first axis.

19. A color cathode ray tube according to claim 18, wherein the means for absorbing deformation of the mask member comprises a circular arc-like projection of the shielding means.

20. A color cathode ray tube according to claim 18, wherein the means for absorbing deformation of the mask member comprises at least two plate-like members, each connected on one side to the adjacent edge portion of the groups, the plate-like members overlapping each other.

21. A color cathode ray tube according to claim 17, wherein the shielding means is separated from the groups and disposed where the groups adjoin.

22. A color cathode ray tube according to claim 15, wherein the faceplate and the mask member are flat.

23. A color cathode ray tube according to claim 22, wherein the vacuum envelope further includes a rear-plate opposing the faceplate, and the mask member is supported by a support member received on the rear-plate.

24. A color cathode ray tube according to claim 23, wherein a tension, parallel to the second axis, is applied to the mask member.

* * * * *